US005295340A

United States Patent [19]

Collins

[11] Patent Number: 5,295,340

[45] Date of Patent: Mar. 22, 1994

[54] DIMENSIONAL SHINGLE FOR HIP, RIDGE AND RAKE PORTIONS OF A ROOF

[75] Inventor: Kenneth E. Collins, Quartz Hill, Calif.

[73] Assignee: Pacific Coast Building Products, Inc., Sacramento, Calif.

[21] Appl. No.: 43,947

[22] Filed: Apr. 5, 1993

[51] Int. Cl.[5] ..... E04D 1/00

[52] U.S. Cl. ..... 52/518; 52/57; 52/531; 52/276

[58] Field of Search ..... 52/57, 58, 518, 523, 52/552-555, 541, 531, 532, 533, 526, 272, 275, 276

[56] References Cited

U.S. PATENT DOCUMENTS

| | | | |
|---|---|---|---|
| 1,592,014 | 7/1926 | Topping | 52/523 |
| 2,113,303 | 4/1938 | Keifer . | |
| 2,259,962 | 10/1941 | Owen . | |
| 2,659,938 | 11/1953 | Crowther | 52/539 |
| 3,159,943 | 12/1964 | Sugar et al. | 52/531 |
| 3,605,369 | 9/1971 | Merrill et al. . | |
| 3,693,305 | 9/1972 | Kneisel | 52/276 |
| 3,852,934 | 12/1974 | Kirkhuff | 52/555 |
| 3,913,294 | 10/1975 | Freiborg . | |
| 3,943,677 | 3/1976 | Carothers | 52/533 |
| 4,015,374 | 4/1977 | Epstein et al. . | |
| 4,187,650 | 2/1980 | Poplin . | |
| 4,191,722 | 3/1980 | Gould . | |
| 4,439,955 | 4/1984 | Freiborg . | |
| 4,464,872 | 8/1984 | Eaton . | |
| 4,577,442 | 3/1986 | Callaway | 52/57 |
| 4,741,131 | 5/1988 | Parker . | |
| 4,835,929 | 6/1989 | Bondoc et al. | 52/518 |
| 4,864,787 | 9/1989 | Bukowski | 52/531 |
| 4,907,499 | 3/1990 | James | 52/57 |
| 4,920,721 | 5/1990 | Pressutti et al. | 52/518 |
| 4,942,699 | 7/1990 | Spinelli | 52/57 |

*Primary Examiner*—Carl D. Friedman
*Assistant Examiner*—Winnie Yip
*Attorney, Agent, or Firm*—Lorthrop & West

[57] ABSTRACT

A shingle unit used for covering the hip, ridge and rake portions of an asphalt shingle roof. The shingle unit includes a top cover permanently bonded to a tapered substrate to create the visual effect of tapered thickness. The shingle is preformed to an inverted, V-shape so as to conform to the hip, ridge or rake portions of a roof. Various notches are formed on the perimeter of the top cover to facilitate longitudinal alignment and surface exposure of the shingles at installation. Depressions are formed on bottom surface of the substrate and are filled with an adhesive during manufacture. After installation, solar heat causes the adhesive to flow between the substrate and the subjacent area of the top cover, or roof, to provide wind uplift resistance.

13 Claims, 3 Drawing Sheets

DIMENSIONAL SHINGLE FOR HIP, RIDGE AND RAKE PORTIONS OF A ROOF

BACKGROUND OF THE INVENTION

1. Field of the Invention

The invention relates to preformed dimensional shingles, for covering the hip, ridge and rake portions of a roof.

2. Description of the Prior Art

The applicant has conducted a customary search and is aware of the following United States Patents, which have some relevance to his invention disclosed herein:

U.S. Pat. No. 4,920,721 to Pressutti discloses a fiberglass shingle with a stiffening member along its length and an elastic sealing member;

U.S. Pat. No. 4,835,929 to Bondoc teaches a flat, bendable shingle with a riser strip laminated to the lower surface of the shingle;

U.S. Pat. No. 3,913,294 to Freiborg discloses a hip or ridge cover utilizing transverse folds to create a thickened portion at the center of the shingle;

U.S. Pat. No. 4,464,872 to Eaton discloses a flat, embossed panel intended to be bent to conform to the hip or ridge portions of a roof;

U.S. Pat. No. 4,191,722 to Gould teaches a process for making composite resin shingle with a protective skin formed thereon.

Some of the listed art depicts shingles which are shipped in a flat configuration, and are later bent during installation to conform to the hip, ridge or rake portions of a roof. Since the bending occurs at ambient temperature at the job site, cracking at the fold line and consequent loss of water tight integrity is a common result. Additionally, prior art shingles requiring bending at installation have a tendency to curl up at the edges. The present invention addresses this problem by providing a shingle unit which is preformed during manufacture to accommodate the hip, ridge or rake portions of a roof.

Other cited references utilize a hollow chamber to create a high profile shingle. Such a method is prone to mechanical damage, temperature deformation and warpage. The preformed shape of the present invention, in conjunction with the continuously tapering, supportive substrate, eliminates the hollow chamber, thus providing a shingle unit that is crush-resistant. The mechanical stability of the underlying substrate also assists in maintaining the original, preformed shape of the shingle unit.

Further, all of the listed art requires the manual application of an adhesive between the hip or ridge shingle U.S. Pat. No. 4,439,955 to Freiborg discloses a shingle with a series of folds used to create a thickened portion in the center of each shingle;

U.S. Pat. No. 2,259,962 to Owen illustrates a hip or ridge cover involving the mating of two wood shingles to form an integral unit;

U.S. Pat. No. 2,223,303 to Kiefer discloses a composition siding shingle for use on the corners of structures;

U.S. Pat. No. 4,015,374 to Epstein teaches a panel intended to simulate a plurality of wood shakes;

U.S. Pat. No. 3,605,369 to Merrill discloses a flat shingle consisting of a light metal shell filled with a non-compressible material;

U.S. Pat. No. 4,577,442 to Callaway shows a clamp or shingle mount intended to hold ridge shingles in proper position along a roof ridge;

U.S. Pat. No. 4,741,131 to Parker illustrates a roofing shingle with a dense outer skin of plastic, fiberglass or metal intended to imitate the look of a slate roof;

U.S. Pat. No. 4,187,650 to Poplin teaches an asphalt shingle, precut and folded so as to create a hollow envelope for use along the hip or ridge of a roof; and the roof, upon installation. The present invention overcomes this labor-consuming step by providing preformed depressions, partially filled with an adhesive, on the underside of the substrate. Shortly after installation of the present dimensional shingle, the adhesive is heated by solar energy, and caused to flow between the shingle and the roof. Upon setting, the adhesive provides a ridge, hip or rake shingle installation which is highly resistant to wind uplift.

SUMMARY OF THE INVENTION

Wood shake roofs have long been used and appreciated for their aesthetically pleasing appearance. However, owing to the cost, weight and potential fire risk presented by wood shakes, composition shingle roofs have become increasingly popular. While providing economic and fire-resistant benefits, a roof constructed with composition shingles lacks the desirable, high-profile, three-dimensional appearance associated with wood shake roofs. The present invention provides such an effect when used in connection with conventional composition shingles. More particularly, the aesthetically desirable look of a series of pairs of wood shakes in longitudinally overlapping relation, along the hip, ridge or rake of a roof, is simulated by a series of the preformed dimensional shingle units.

The invention disclosed in this application employs structure not shown or suggested in known prior art. The present construction provides a high profile shingle, having an inverted V-shape in cross-section. The shingle is composed of a lightweight, resilient substrate, permanently bonded to a protective top cover, sheet or panel.

During manufacture, the cover and substrate are preformed into a configuration which closely conforms to the portions of the roof to be covered by the shingle. The resilient underlying substrate further allows maximum face-to-face engagement over the entire lower surface of the unit, regardless of the pitch of the roof to which it is applied. Thus, unlike shingles which are shipped in a flat configuration, the present shingle construction is easy to install, yet is neither prone to curl at the edges nor to sag in the center portion, over time.

One end of the underlying substrate is preferably provided with a slit extending a short distance along the shingle's median longitudinal axis, so that, if necessary the shingle can readily be bent to conform to various roof angles. In the event a particular roof angle were to require bending of the shingle beyond its preformed angle, the slit allows the underlying foam material to tear cleanly along the median, longitudinal axis of the substrate, allowing the shingle cover to retain its appearance and structural integrity.

At predetermined locations, alignment notches are formed in the side edges of the top cover. The notches facilitate the installation of a plurality of shingles by serving as exposure, or longitudinal overlap indicators as well as facilitating the coaxial alignment of the shingles along the hip, ridge or rake line.

The present shingle creates an aesthetically pleasing, wood shake effect of tapered thickness resulting from the configuration of the substrate, or pad, of material attached to the underside and tapered along the length of the shingle. This construction results in a high-profile shingle which will not crack upon installation and which has a high degree of contact between overlapping shingle-to-roof and shingle-to-shingle structures. Owing to its design, the present shingle is also highly resistant to wind, temperature and mechanical damage.

It is therefore an object of this invention to create a high profile preformed shingle for the protection of the hip, ridge and rake portions of a roof, which is both aesthetically pleasing and easy to install.

A further object of this invention is to provide a hip and ridge cover which is structurally stable, and not prone to warpage or wind damage.

Other objects, together with the foregoing, are obtained in the embodiment discussed in the following description and illustrated in the accompanying drawings.

BRIEF DESCRIPTION OF THE DRAWING FIGURES

DETAILED DESCRIPTION OF THE PREFERRED EMBODIMENT

Figure 1:
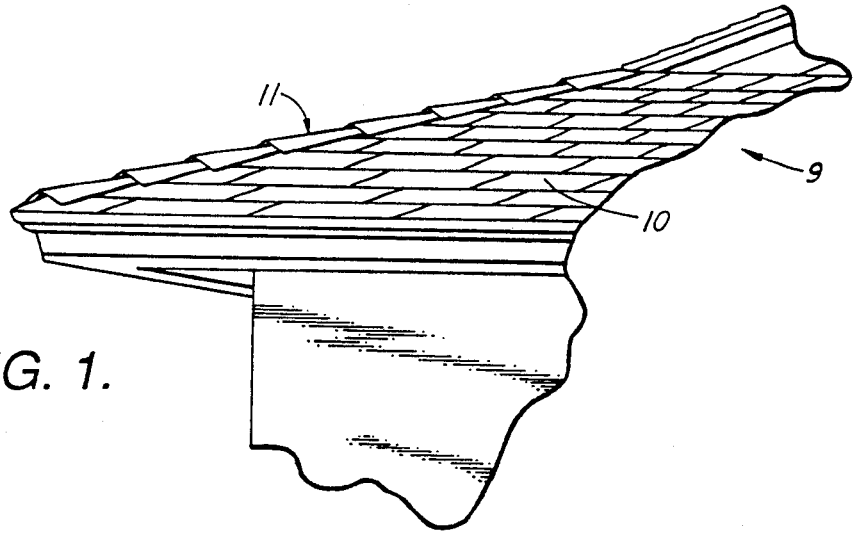
FIG. 1 illustrates the present shingle in a typical hip roof installation.

Turning now to FIG. 1, a residential style roof 9 comprises a plurality of composition shingles, designated by the numeral 10, and a plurality of shingle units 11 of the present shingle, in a typical installation on the hip portion of a roof. It should be noted that the thin flat asphalt shingles 10 are basically two dimensional and lack the high profile appearance associated with wood shake roofs. The present shingle unit 11, installed along the hip of the roof, enhances the look of this conventional asphalt shingle roof by providing vertical dimension to the roof line, while directing attention away from the flat, featureless portions of the roof.

Figure 2:
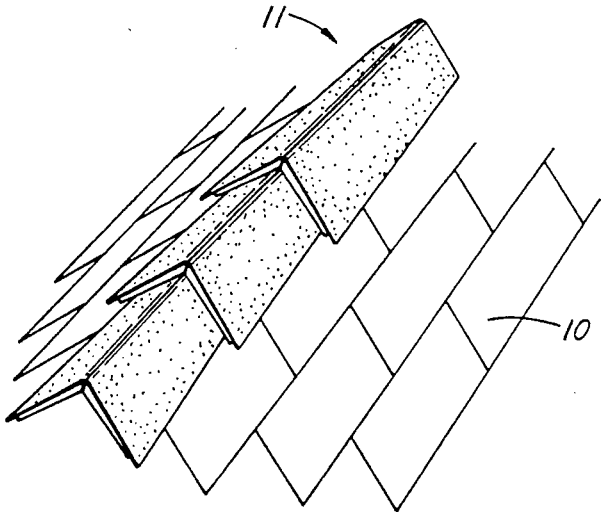
FIG. 2 is a perspective view of a plurality of shingles installed on a typical roof ridge or hip.

FIG. 2 provides a more detailed view of a typical assembly of the present shingle units 11 either on a roof hip or ridge installation. Especially to be noted is the desirable, high profile of the present shingle unit 11, which gives a sense of tapered thickness to the entire roof.

As is illustrated in FIGS. 3–7, the shingle unit 11, in its preferred embodiment, includes a substantially rectangular in plan, substrate 21, or pad, permanently attached to, and substantially co-extensive with, the underside of a preformed top cover sheet 22. The substrate 21 has a pair of connected panels 23 and 24, which extend from a relatively thick leading end portion 15 to a thin trailing end portion 16. The substrate 21 thus provides a longitudinally tapering thickness to the shingle 11.

Figure 6:
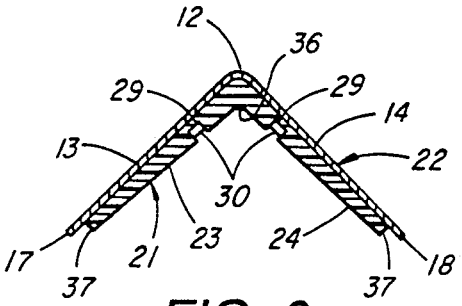
FIG. 6 is a transverse, cross-sectional view, taken along line 6—6 in FIG. 5.
Figure 7:
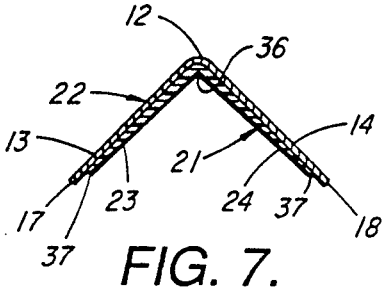
FIG. 7 is a transverse, cross-sectional view, taken along line 7—7 in FIG. 5.

In transverse section, the shingle unit 11 displays an inverted-V configuration (see FIGS. 6 and 7). The rectangular in plan, top cover sheet 22 includes opposite sloping side panels 13 and 14, descending from a preformed fold 12, or peak, to respective longitudinal bottom edges 17 and 18. Top cover sheet 22 also has a median, longitudinal axis along the fold, joining panels 13 and 14.

Pairs of exposure indicator notches 32 are provided in the bottom edges 17 and 18 of the respective side panels 13 and 14, on opposing sides of the shingle. Notches 32 are preferably located at distances of 7", 8" and 9" from the leading edge of the shingle. Exposure indicator notches 32 are preferably triangular in shape, with a depth of about one-quarter of an inch. The exposure indicators are intended to facilitate the longitudinal positioning of overlying shingles, relative to each other, upon installation. By aligning the leading edge of the overlying shingle with the appropriate pair of notches 32 in the underlying shingle, the installer can easily and accurately select the desired surface exposure of the underlying shingle.

A typical roof installation involves creating a straight line, such as a chalk line, along the length of the hip or ridge of a roof. The installer uses this line as a reference so that the subsequent installation of the hip or ridge shingles is perfectly straight. For this purpose, an alignment notch 33 is provided at the trailing or after end of the peak 12 of the top cover 22 (see FIGS. 3–5). The alignment notch is preferably triangular in shape, with a depth of about one quarter of an inch. By aligning the reference line with the alignment notch 33 in the after end of the shingle, perfect alignment along the hip or ridge line is maintained.

Figure 4:
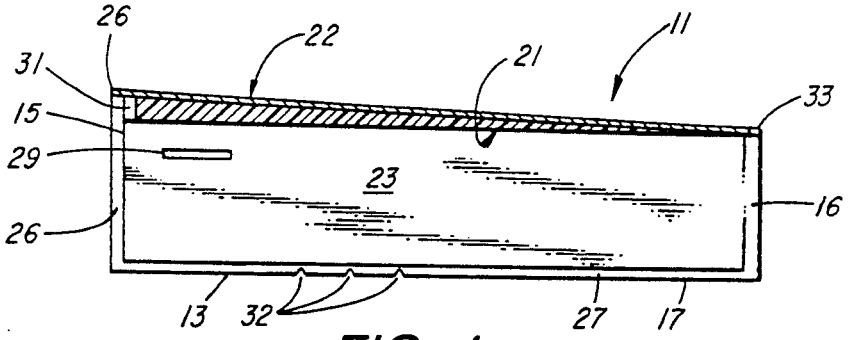
FIG. 4 is a longitudinal, cross-sectional view, taken along line 4—4 in FIG. 3.

FIG. 4 particularly illustrates the front to rear taper of the underlying substrate 21, or pad, which is used to create the visual effect of tapered thickness in the shingle, similar to that of wood shake.

The substrate 21 of the present invention also includes a top to bottom taper, best evident in FIGS. 6 and 7. The transverse sectional view of FIG. 5 likewise shows the compound tapered configuration of the underlying substrate 21, as mentioned above. Also shown is the extent of the overhang provided by a front end portion 26 of the top cover sheet 22, and by two side edge portions 27 and 28, or strips, which extend rearwardly along the longitudinal dimension of the shingle toward the trailing end portion 16. The overhangs not only protect the substrate from ultraviolet radiation, but provide aesthetically pleasing shadow lines across the adjacent shingles.

Figure 3:
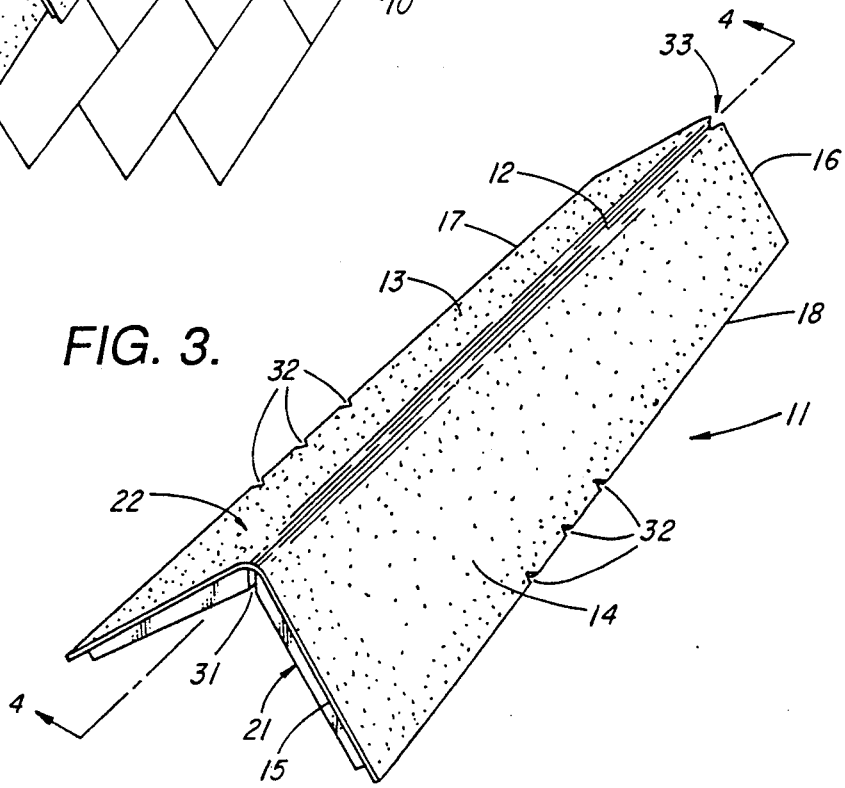
FIG. 3 is a left front perspective view of a single shingle of the present design.
Figure 5:
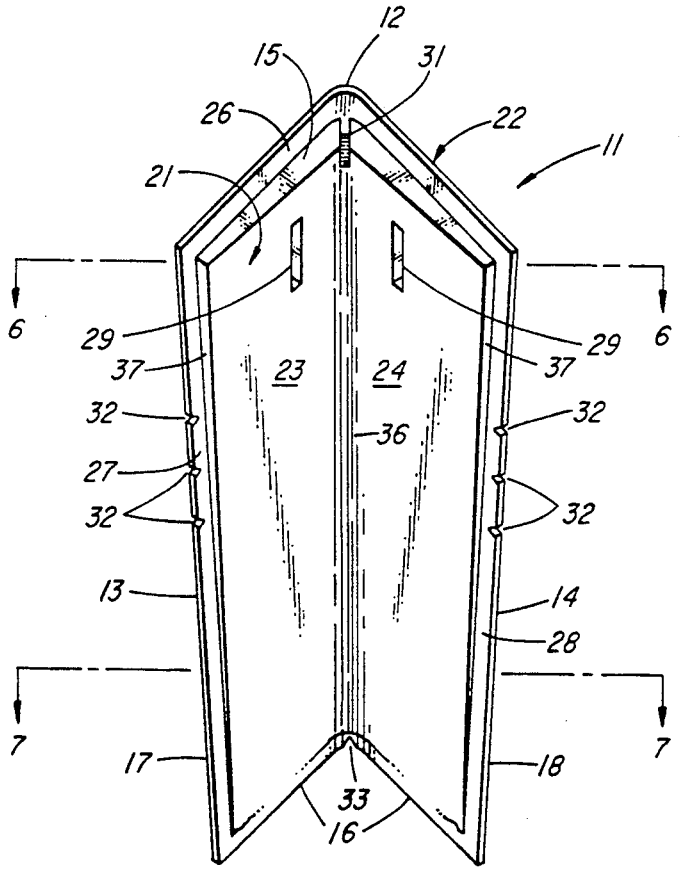
FIG. 5 is a bottom perspective view of the shingle.

FIGS. 3–5 also show a short medial slit 31, in the leading end of the peak 36 of the substrate 21. The slit 31 facilitates a clean, linear separation down the median longitudinal axis of the substrate 21, when the shingle is bent open a few degrees, to be applied to hip, ridge or rake angles that are substantially more than the customary seventy degree preformed angle of the shingle. The top cover sheet 22 and the substrate 21 are sufficiently flexible to accommodate bending of the shingle to an angle of less than seventy degrees, where necessary.

The depressions 29 formed in the substrate 21, shown in FIGS. 4–6, are filled with an adhesive 30 (see FIG. 6), preferably a low melting point asphalt. The adhesive 30 is recessed from the lower surface of the substrate 21 so that it will not adhere to adjacent shingles during shipment.

Figure 8:
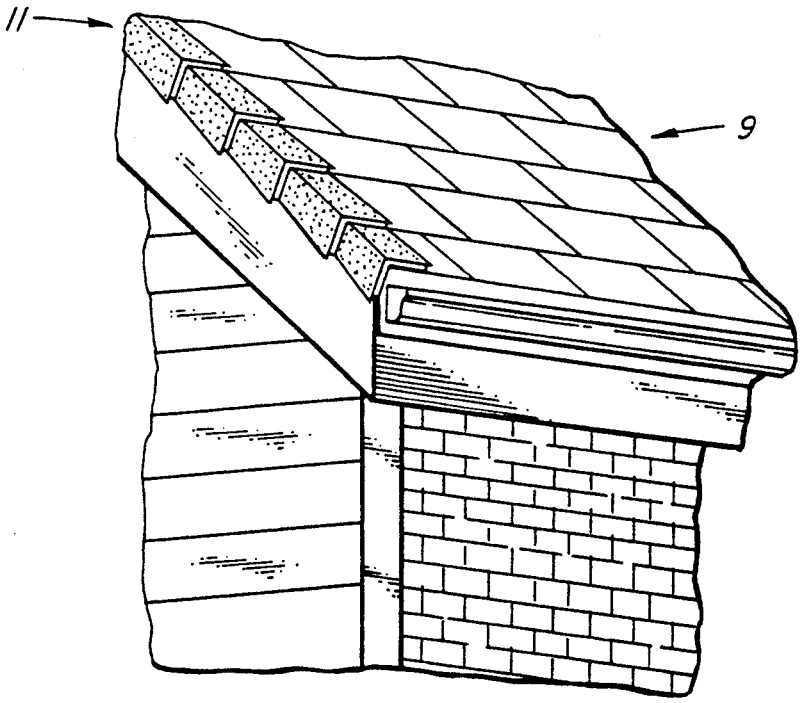
FIG. 8 illustrates the present shingle in a typical rake application.

FIG. 8 illustrates a plurality of the present shingle units 11 in a typical installation along the rake of a roof. In a typical rake application, a plurality of the shingle units 11 are installed along the sloping portions of the exposed perimeter of a roof. The shingle units 11 are arranged and secured in a manner somewhat similar to that used on the hip or ridge of a roof, thereby protecting the underlying shingle ends from the elements.

It is to be noted that a variety of materials is suitable for use as the substrate 21, including various types of foam materials, plastic, rubber or wood-based products, fiberglass, or metal honeycomb structures, to name a few. Further, while a single piece of material is a preferred embodiment for the top cover sheet 22, the present invention is not limited to such a configuration. Two pieces of suitably overlapping sheet material may be bonded together to form an integral piece and joined with a continuously tapering, underlying substrate 21. Additionally, the top cover sheet 22 need not be limited to an asphalt composition shingle tab, and may be constructed, molded, or extruded from any suitable material such as fiberglass, ceramic materials, MASONITE®, wood or metal.

One process used in the manufacture of the present shingle unit 11 is to react two-component urethane foam in conjunction with a precut flat asphalt shingle in a V-shaped mold, temperature stabilized within a range of around 110–115 degrees Fahrenheit. The heat generated by the exothermic reaction of the urethane foam components, in conjunction with the heat of the mold, facilitates the formation of the appropriate bend in the pre-molded shingle.

In another process, a preformed wedge of resilient, weather-resistent backing, such as urethane foam, is permanently attached to the underside of a conventional asphalt shingle. In a preferred embodiment, the substrate would have a thickness of approximately ¾" adjacent the front end of the shingle, and would taper to a negligible thickness adjacent the after end of the shingle; and, the substrate would also taper from the peak 12, toward the bottom edges. During the manufacturing process, the preformed substrate wedge and the asphalt shingle cover 22 are permanently bonded together, heated, then cooled to set, and preformed so as to accommodate the slope of an average roof ridge, rake or hip, usually, about seventy degrees. When the shingle unit 11 is installed along the hip, ridge or rake of a roof, the preformed bend affords a predetermined, consistent surface, with the substrate panels matching the subjacent planar surfaces of the roof or of the underlying cover sheet panels. This, in turn, provides protection from moisture and maximum resistance to wind uplift. The preformed shape also prevents the shingle from curling up, as can occur with shingles which are shipped in the flat configuration.

The thickness of the substrate 21 tapers toward the rear and toward the opposite, bottom edges of the shingle, as well, so that, when an overlapping series of shingles is assembled along the ridge or hip of a roof, a stepped or sawtooth pattern is created. This in turn, creates the visual effect of thickness or vertical dimension, similar to that of the more expensive wood shake roofs, while incorporating the durability and fire-resistant benefits of asphalt shingles.

An additional feature of the shingle, as previously noted, are indentations 29, or depressions, within the underside of each of the substrate panels 23 and 24. During manufacture, each depression is filled with an adhesive 30, preferably a low-melt asphalt. The depressions 29 are filled to a level below the exposed surface of the substrate to prevent stacked shingles from prematurely adhering to each other during shipment. Following manufacture and cooling to room temperature, the shingles can therefore safely be stacked and shipped.

At the job site, the shingles are attached to the ridge, hip or rake portions of a roof by nails, screws or other mechanical fasteners. Thermal energy provided by exposure to the sun, causes the adhesive 30 within the depressions 29 to flow between the substrate 21 and the underlying surface of the top cover sheet 22, or roof surface. When set, the adhesive provides additional wind uplift resistance and sealing against the elements.

What is claimed is:

1. A hip, ridge and rake shingle comprising:

a. a top cover sheet, substantially rectangular in top plan, said top cover sheet being preformed into an inverted V-shape in cross-section and having a pair of side panels extending from a bendable median longitudinal peak to longitudinal bottom lateral edges, said side panels of said top cover sheet including a front end portion, a rear end portion, an upper surface and a lower surface; and, b. a flexible and resilient substrate, substantially rectangular in bottom plan, said substrate being mounted on said lower surface of said top cover, said substrate having a leading end portion, located adjacent said front end portion of said side panels of said top cover sheet, a trailing end portion, located adjacent said rear end portion of said side panels of said top cover sheet, and a bottom surface, said substrate being preformed so as to have an inverted, V-shaped cross-section with a median longitudinal peak and bottom lateral edges and having a length and width less than the respective length and width of said top cover, so that said top cover sheet extends beyond the perimeter of said substrate to form an overhang around said perimeter, said leading end portion of said substrate being of substantially greater thickness than the thickness of said top cover, said substrate having a thickness tapering from said leading end portion of said substrate along the length thereof toward said trailing end portion, whereby said side panels of said cover sheet and said substrate are adapted to be bent around respective to conform to the configuration of an underlying hip, ridge, or rake.

2. A hip, ridge and rake shingle comprising:

a. a to cover including at least two panels bonded so as to form an integral piece, said integral piece being preformed into an inverted V-shape in cross-section and having a pair of side panels extending from a bendable median longitudinal peak to longitudinal bottom lateral edges, said side panels of said top cover sheet including a front end portion, a rear end portion, an upper surface and a lower surface; and, b. a flexible and resilient substrate mounted on said lower surface of said top cover, said substrate having a leading end portion, located adjacent said front end portion of said side panels of said top cover sheet, a trailing end portion, located adjacent said rear end portion of said side panels of said top cover sheet, and a bottom surface, said substrate being preformed so as to have an inverted, V-shaped cross-section with a median longitudinal peak and bottom lateral edges and having a length and width less than the respective length and width of said top cover, so that said top cover sheet extends beyond the perimeter of said substrate to form an overhang around said perimeter, said leading end portion of said substrate being of substantially greater thickness than the thickness of said top cover, said substrate having a thickness tapering from said leading end portion of said substrate along the length thereof toward said trailing end portion, whereby said side panels of said cover sheet and said substrate are adapted to be bent around respective said longitudinal peaks, precisely to conform to the configuration of an underlying hip, ridge, or rake.

3. A hip, ridge and rake shingle as in claim 1, in which the width of said substrate is substantially equal to that of said top cover sheet.

4. A hip, ridge and rake shingle as in claim 1 in which the thickness of said substrate tapers from said median longitudinal peak of said substrate toward said bottom lateral edges thereof.

5. At least a pair of shingles as in claim 1, in which said bottom surface of said leading end portion of said substrate of one of said shingles overlaps said upper surface of said rear end portion of said top cover sheet of another subjacent one of said shingles.

6. A hip, ridge and rake shingle as in claim 12 in which said top cover sheet is formed of an asphalt composition shingle material.

7. A hip, ridge and rake shingle as in claim 1 in which said substrate is formed of a foam material.

8. A hip, ridge and rake shingle as in claim 1, in which said substrate includes a slit along the median, longitudinal peak thereof, said slit extending along at least a portion of the length of said median longitudinal peak of said substrate, to facilitate bending of said shingle.

9. A hip, ridge or rake shingle as in claim 1, in which said top cover sheet includes means for longitudinal alignment of said shingle with respect to a reference line along the hip, ridge or rake of a roof.

10. A hip, ridge or rake shingle as in claim 9 in which said longitudinal alignment means comprises a notch formed in said median longitudinal peak of said rear end portion of said top cover sheet.

11. At least a pair of shingles as in claim 1 in which an underlying one of said shingles includes means for indicating the exposure of said upper surface of said top cover sheet of said shingle with respect to a leading end portion of an overlying another one of said shingles.

12. A shingle as in claim 11 in which said exposure indicating means comprises a plurality of spaced pairs of notches formed along said longitudinal bottom lateral edges of said top cover sheet of said underlying one.

13. A shingle as in claim 1 in which said substrate includes at least one depression formed in the bottom surface thereof, said depression being partially filled with a low temperature melt adhesive, adapted to flow between said substrate and an underlying surface when subjected to solar heating.

* * * * *

UNITED STATES PATENT AND TRADEMARK OFFICE

CERTIFICATE OF CORRECTION

PATENT NO. : 5,295,340

DATED : March 22, 1994

INVENTOR(S) : Kenneth E. Collins

It is certified that error appears in the above-identified patent and that said Letters Patent is hereby corrected as shown below:

Col. 6, line 47, between "respective" and "to", first occurrence, insert --said longitudinal peaks, precisely--.

Col. 6,
Claim 2, line 2, correct "a to cover" to read --a top cover--.

Col. 7,
Claim 6, line 1, correct "claim 12" to read --claim 1--.

Signed and Sealed this

Twenty-sixth Day of July, 1994

*Attest:*

Bruce Lehman

BRUCE LEHMAN

*Attesting Officer*

*Commissioner of Patents and Trademarks*